US008166597B2

(12) United States Patent
Levitt et al.

(10) Patent No.: US 8,166,597 B2
(45) Date of Patent: May 1, 2012

(54) FLAT MOP WITH ABRASIVE PAD

(75) Inventors: Mark Levitt, Lake Elmo, MN (US); Brian R. Leafblad, St. Paul, MN (US); Paul J. Mattia, Prior Lake, MN (US)

(73) Assignee: Ecolab USA Inc., St. Paul, MN (US)

( * ) Notice: Subject to any disclaimer, the term of this patent is extended or adjusted under 35 U.S.C. 154(b) by 527 days.

(21) Appl. No.: 12/372,245

(22) Filed: Feb. 17, 2009

(65) Prior Publication Data

US 2010/0205758 A1 Aug. 19, 2010

(51) Int. Cl.
*A47L 13/10* (2006.01)
*A47L 13/12* (2006.01)
*A47L 17/08* (2006.01)

(52) U.S. Cl. ..... 15/118; 15/228; 15/244.1; 15/244.2; 15/229.11

(58) Field of Classification Search ..... 15/114, 15/115, 118, 147.1, 147.2, 148, 228, 244.1, 15/244.2, 144.1, 144.2, 105, 229.11, 104.8, 15/142

See application file for complete search history.

(56) References Cited

U.S. PATENT DOCUMENTS

| | | | | | |
|---|---|---|---|---|---|
| 908,791 | A | * | 1/1909 | Mason | 15/105 |
| 2,701,888 | A | * | 2/1955 | Vosbikian et al. | 15/115 |
| 2,727,268 | A | * | 12/1955 | Hucke | 15/229.8 |
| 3,199,139 | A | * | 8/1965 | Vallis | 401/22 |
| 3,778,860 | A | * | 12/1973 | Thielen | 15/147.2 |
| 3,792,505 | A | * | 2/1974 | Saltzstein | 15/231 |
| 3,906,580 | A | * | 9/1975 | Smith et al. | 15/115 |
| 3,947,915 | A | * | 4/1976 | Kroll | 15/229.13 |
| 4,127,911 | A | * | 12/1978 | Cupp et al. | 15/210.1 |
| 4,852,210 | A | * | 8/1989 | Krajicek | 15/228 |
| 5,074,008 | A | * | 12/1991 | Palomino, Jr. | 15/403 |
| 5,094,559 | A | * | 3/1992 | Rivera et al. | 401/132 |
| 5,402,509 | A | * | 3/1995 | Fukushima | 385/33 |
| 5,461,749 | A | | 10/1995 | Ahlberg et al. | |
| 5,522,110 | A | * | 6/1996 | Borofsky | 15/116.2 |
| 5,584,091 | A | * | 12/1996 | Borofsky | 15/115 |
| 5,680,667 | A | | 10/1997 | Kresse et al. | |

(Continued)

FOREIGN PATENT DOCUMENTS

WO WO-2006074687 A1 7/2006

OTHER PUBLICATIONS

3M Building and Commercial Services, 3M Easy Clean System, Product description.

(Continued)

*Primary Examiner* — Joseph J Hail
*Assistant Examiner* — Tyrone V Hall, Jr.
(74) *Attorney, Agent, or Firm* — IPLM Group, P.A.

(57) ABSTRACT

A cleaning device that includes a first component, a second component and a handle. The first component is configured to hold a first portion of the cleaning device. The second component is configured to hold a second portion of the cleaning device. The first and second components are connected and are configured so that the first portion and the second portion on the respective first and second components are independently replaceable. The handle is coupled to the second component to control an application of at least one of the first portion and the second portion of the cleaning device on a surface to be cleaned.

17 Claims, 5 Drawing Sheets

U.S. PATENT DOCUMENTS

| | | | | |
|---|---|---|---|---|
| 5,875,509 | A * | 3/1999 | Facca | 15/120.1 |
| 5,887,311 | A | 3/1999 | Kresse et al. | |
| 6,233,777 | B1 | 5/2001 | Kresse et al. | |
| 7,328,477 | B1 * | 2/2008 | Aiyar et al. | 15/228 |
| 7,690,069 | B2 * | 4/2010 | Chen et al. | 15/115 |
| 7,841,039 | B1 * | 11/2010 | Squire | 15/118 |
| 7,856,691 | B2 * | 12/2010 | Viggiani | 15/118 |
| 2003/0044569 | A1 | 3/2003 | Kacher et al. | |
| 2003/0049407 | A1 | 3/2003 | Kacher et al. | |
| 2003/0074757 | A1 | 4/2003 | Brinker | |
| 2003/0084531 | A1 * | 5/2003 | Dingert et al. | 15/147.2 |
| 2003/0140441 | A1 * | 7/2003 | Stafford | 15/118 |
| 2004/0068817 | A1 | 4/2004 | Policicchio | |
| 2004/0111817 | A1 | 6/2004 | Chen et al. | |
| 2005/0060827 | A1 | 3/2005 | James et al. | |
| 2005/0120499 | A1 | 6/2005 | Kresse et al. | |
| 2005/0132518 | A1 | 6/2005 | Chen et al. | |
| 2005/0155631 | A1 | 7/2005 | Kilkenny et al. | |
| 2006/0010627 | A1 * | 1/2006 | Godfroid et al. | 15/104.8 |
| 2006/0048318 | A1 | 3/2006 | Goh et al. | |
| 2006/0070196 | A1 * | 4/2006 | Lacotta et al. | 15/118 |
| 2006/0260078 | A1 * | 11/2006 | Ranks | 15/115 |
| 2007/0061987 | A1 | 3/2007 | Kresse et al. | |
| 2007/0094827 | A1 | 5/2007 | Kilkenny et al. | |
| 2009/0199868 | A1 * | 8/2009 | Cybulski et al. | 134/6 |

OTHER PUBLICATIONS

Rubbermaid Commercial Products, Microfiber Pads, Cloths and Mitts, http://www.rcpworksmarter.com/rcp/products/detail.jsp?rcpNum=Q810, Oct. 29, 2007.

* cited by examiner

FIG. 2
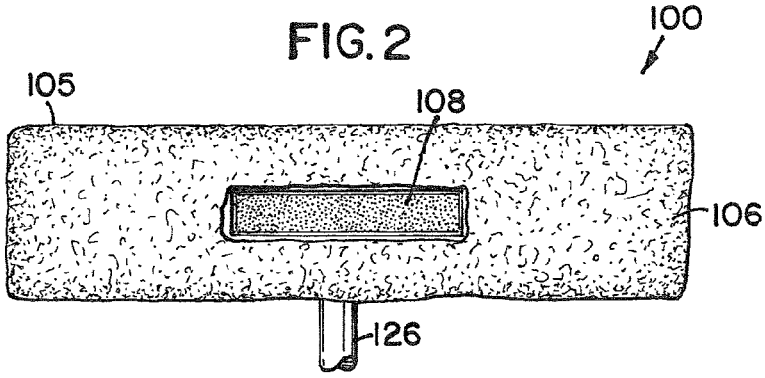
FIG. 3
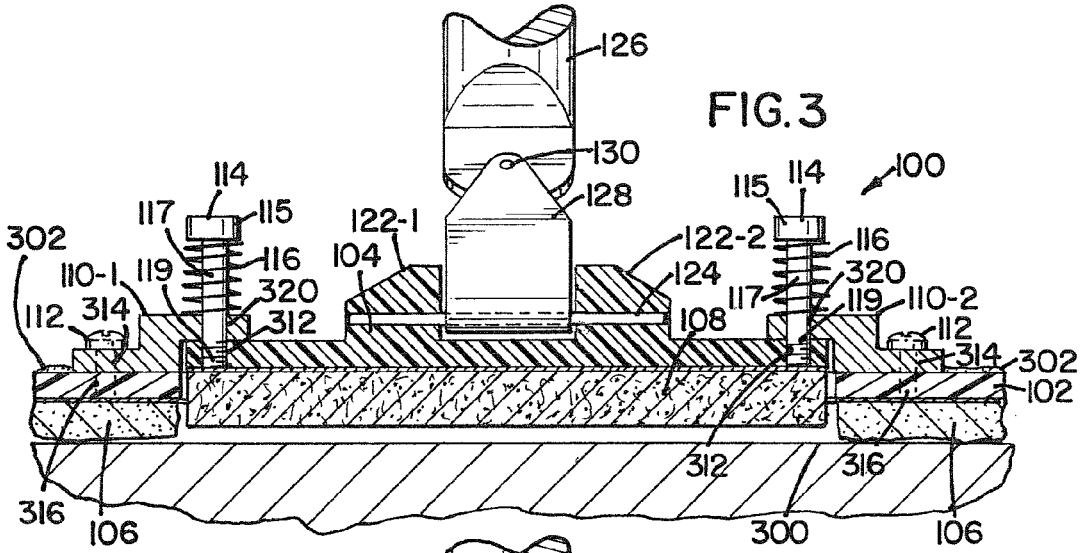
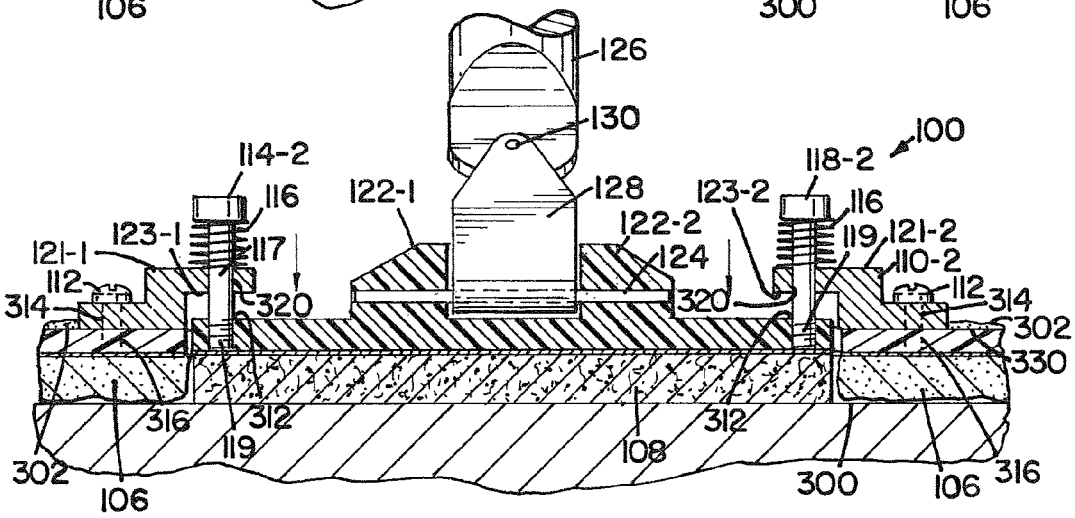
FIG. 4

FIG. 5
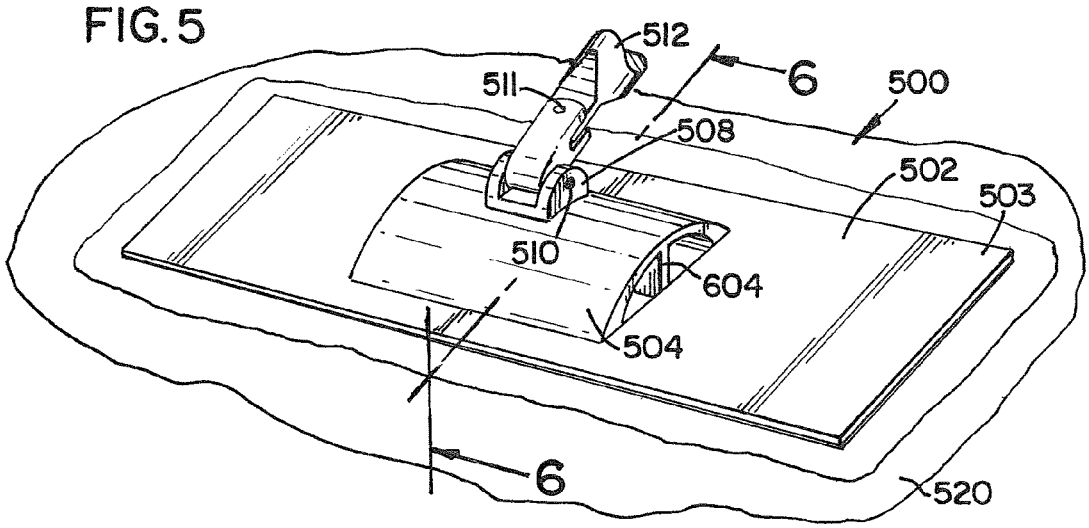
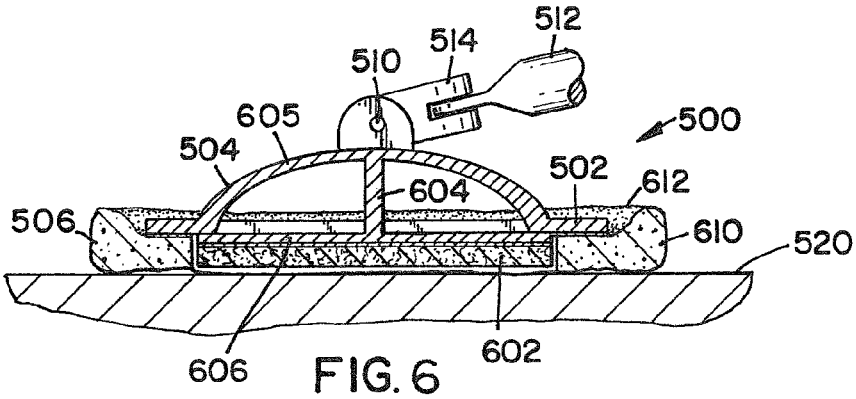
FIG. 6
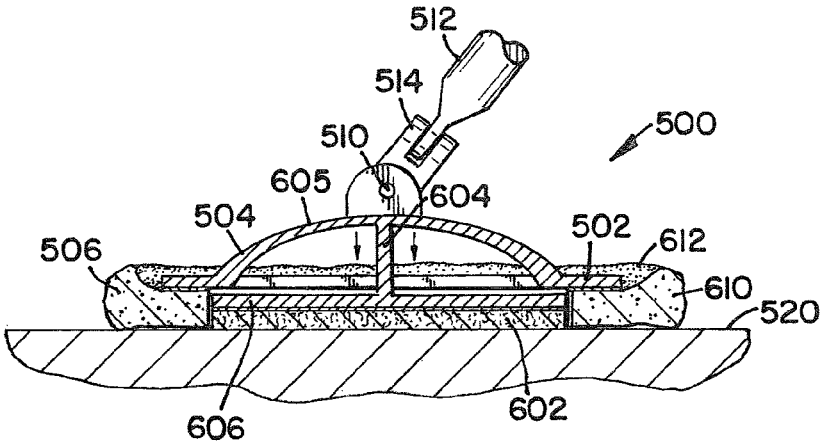
FIG. 7

FLAT MOP WITH ABRASIVE PAD

BACKGROUND

One method of cleaning floor surfaces is with the use of a mop. A flat mop is one type of a mop used to clean floors. An example of a flat mop is a pad of microfiber material attached to a handle. A flat mop is designed to pick up and collect unwanted material such as dirt, dust, etc., from a floor by moving the flat mop across the floor's surface. A flat mop can be designed to be used dry or wet. Although flat mops generally work well to pick up dirt, dust, etc., they are generally ineffective at removing hard to remove substances such as scuff, heel marks, stubborn grime and the like.

For the reasons stated above and for other reasons stated below which will become apparent to those skilled in the art upon reading and understanding the present specification, there is a need in the art for a cleaning device that is effective and efficient in removing not only dirt and dust but also hard to remove substances such as scuff marks.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a cleaning device is provided. The cleaning device includes a first component, a second component and a handle. The first component is configured to hold a first portion of the cleaning device. The second component is configured to hold a second portion of the cleaning device. The first and second components are connected and are configured so that the first portion and the second portion on the respective first and second components are independently replaceable. The handle is coupled to the second component to control an application of at least one of the first portion and the second portion of the cleaning device on a surface to be cleaned.

BRIEF DESCRIPTION OF THE DRAWINGS

The present invention can be more easily understood and further advantages and uses thereof more readily apparent, when considered in view of the detailed description and the following figures in which:

FIG. 2 is a bottom view of the cleaning device of the embodiment of FIG. 1;

FIG. 3 is a front cross-sectional view of the embodiment of FIG. 1 taken generally along the lines 3-3 illustrating the scrub pad in an inactive position;

FIG. 4 is a front cross-sectional view of the embodiment of FIG. 1 taken generally along the lines 3-3 illustrating the scrub pad in an active position;

FIG. 5 is a top perspective view of another embodiment of a cleaning device of the present invention;

FIG. 6 is a side cross-sectional view of the embodiment of the FIG. 5 taken generally along the lines 6-6 illustrating the scrub pad in an inactive position;

FIG. 7 is a side cross-sectional view of the embodiment of the FIG. 5 taken generally along the lines 6-6 illustrating the scrub pad in an active position;

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that mechanical changes may be made without departing from the spirit and scope of the present invention. The following detailed description is, therefore, not to be taken in a limiting sense, and the scope of the present invention is defined only by the claims and equivalents thereof.

Figure 1:
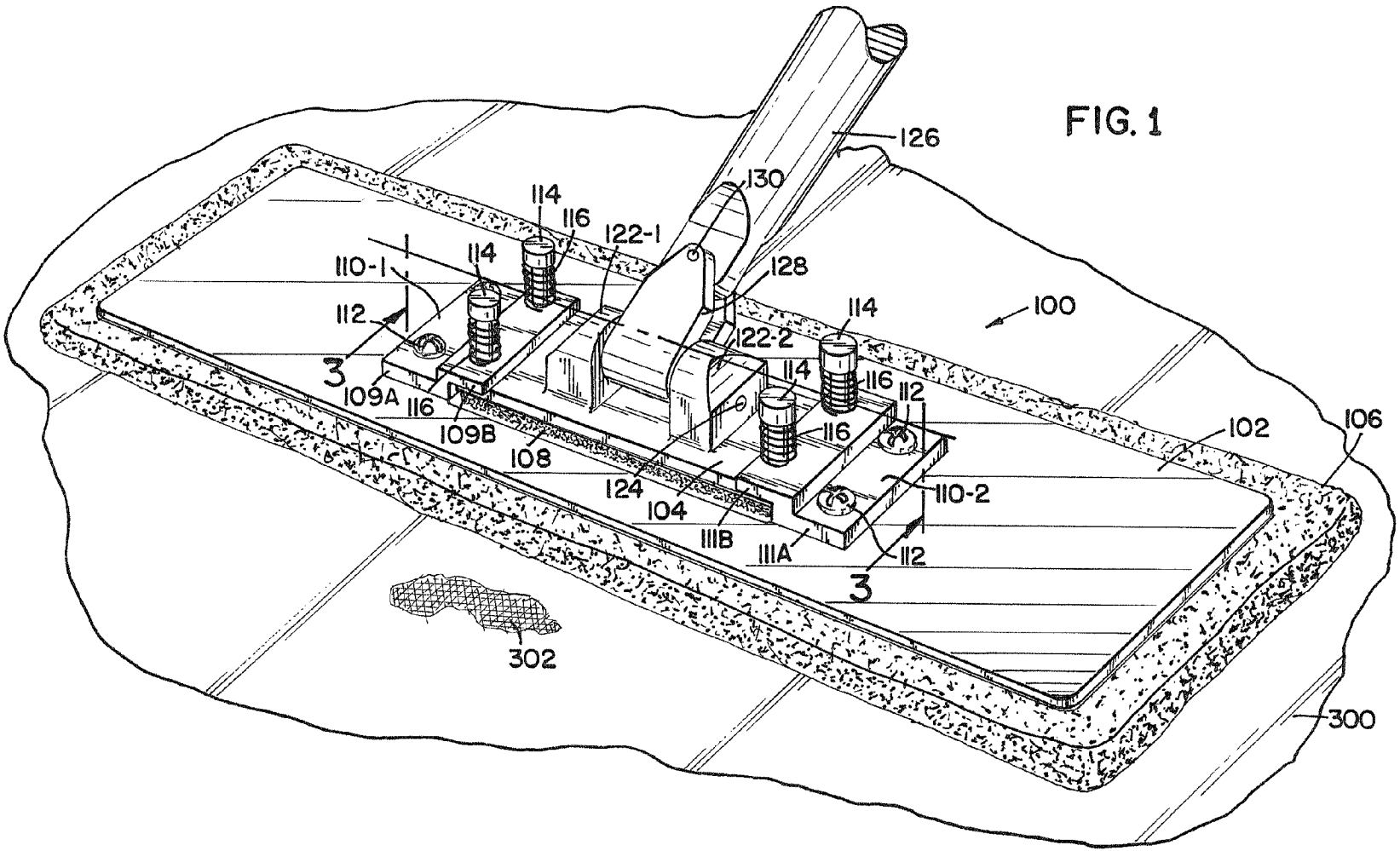
FIG. 1 is a top perspective view of a cleaning device of one embodiment of the present invention.

Embodiments of the present invention provide a cleaning device that provides the functions of a mop as well as a scrub pad (abrasive pad). In embodiments, the scrub pad is selectively activated when needed. Moreover in embodiments, the mop portion is independently replaceable from the scrub pad portion. Hence different types of mop portions can be used with different types scrub pads. An example of a typical mop portion is made from a microfiber material such as nylon and polyester. Scrub pads come in different abrasion levels. Hence, embodiments provide a configurable cleaning device. Referring to FIG. 1, a top perspective view of one embodiment of a cleaning device 100 (flat mop with abrasive pad) is illustrated. The cleaning device 100 includes a first component 102 and a second component 104. The first component 102 is a support for mop portion 106. The mop portion 106 is used to generally clean a surface of the floor 300. The second component 104 is support for the scrub pad 108. The scrub pad 108 is used to remove hard to remove substances on the floor surface 300 such as scuff mark 302 of FIG. 1.

In the embodiment of FIG. 1, the second component 104 is connected to the first component 102 via first and second brackets 110-1 and 110-2. Each bracket 110-1 and 110-2 includes a first and second portion. In particular, the first bracket 110-1 includes first portion 109A and second portion 109B and the second bracket 110-2 includes first portion 111A and a second portion 111B. As illustrated, the respective second portion 109B and 111B of the first and second brackets 110-1 and 110-2 are positioned in a plane that is a select distance apart from a plane of their respective first portions 109A and 111A of the first and second brackets 110-1 and 110-2. This allows the scrub pad 108 coupled to the second component 104 to be raised to an inactive position when not in use. The first portions 109A and 111A of the first and second brackets 110-1 and 110-2 are coupled to the first component 102 via fasteners 112 which in one embodiment are screws. In other embodiments, the first and second brackets 110-1 and 110-2 are integral to the first component 102. The second portions 109B and 111B of the first and second brackets 110-1 and 110-2 are movably coupled to the second component 104 via retaining guide members 114. Biasing members 116, springs in the embodiment of FIG. 1, retain the second component 104 in the inactive position when not in use. This is further described below in regards to FIGS. 3 and 4. Referring back to FIG. 1, a handle 126 is coupled (rotatably coupled in this embodiment) to the second component 104. In particular, in the embodiment of the FIG. 1, handle 126 is pivotally coupled to a connection portion 128 via retaining pin 130 and the connection portion 128 is further pivotally coupled to the second component 104 via handle engaging portions 122-1 and 122-2 of the second component 104 and retaining pin 124 as illustrated.

Referring to FIG. 2 a bottom view of cleaning device 100 is illustrated. As illustrated, in this embodiment the scrub pad 108 is contained within a boundary defined by an outer perimeter 105 of the mop portion 106. Hence, in this embodiment, the scrub pad 108 is surrounded by the mop portion 106 in all directions in a plane formed by the mop portion 106. In FIG. 3 a side cross-sectional view of the cleaning device 100 is provided illustrating an inactive position of the scrub pad 108. As illustrated, in this inactive position, the scrub pad 108 is not in contact with the floor surface 300. The retaining guide members 114 are further illustrated having a head end 115, a mid portion 117 and a threaded end 19. The mid portion 117 of each retaining guide member 114 is slideably received in a retaining guide aperture 320 in the second portion 109B and 111B of each retaining bracket 110-1 and 10-2. The threaded end 119 (or engaging end) of each retaining guide member 114 is threadably engaged with a threaded bore 312 in the second component 104. The spring 116 associated with the retaining guide member 114 is positioned around the mid portion 117 of the retaining guide member 114 between an upper surface 121-1 or 121-2 of the second portion 109B or 111B of the first or second bracket 110-1 and 110-2 and the head end 115. As illustrated, in FIG. 3, each spring 116 biases the head end 115 of an associated retaining guide member 114 away from the second portion 109B or 111B of the first or second bracket 110-1 and 110-2. This biasing retains the second component 104 against a lower surface 123-1 and 123-2 of the second portion 109B and 111B of the first and second bracket 110-1 and 110-2. As discussed above, this is the inactive position with the scrub pad 108 raised from the surface of the floor 300.

In FIG. 4, a side cross-sectional view of the cleaning device 100 is provided illustrating an active position of the scrub pad 108. In the active position, the scrub pad 108 engages the surface of the floor 300. The active position is achieved by asserting a force on the second component 104 with the handle 126. Hence, a user simply applies a force downward on the handle 126 to move the scrub pad 108 in the active position. The force counters the biasing of the springs 108. Hence the amount of force needed to achieve the active position can be selected by using springs with defined biasing strengths. FIGS. 3 and 4 also illustrate the fasteners 112 that connect the first portion 109A and 111A of the first and second brackets 110-1 and 110-2 are screws 112 is this embodiment. The screws 112 pass through associated apertures 314 in the first portion 109A and 111A of the first and second brackets 110-1 and 110-2 and threadably engage threaded bores 316 in the first component 102. As discussed above, in another embodiment the first portion 109A and 111A of the first and second brackets 110-1 and 110-2 are integral with the first component 102. FIGS. 3 and 4 also illustrate a mop retaining portion 302 of the mop portion 106 that is positioned over a top surface 330 of the first component 102 to retain the mop portion 106 on the first component 102.

FIG. 5 is a front perspective view of another embodiment of a cleaning device 500. This embodiment also includes a first component 502 and a second component 504. A connection bracket 508 is coupled to the second component 504. A handle connector 514 is pivotally coupled to connection bracket 508 via retaining pin 510. Further, a handle 512 is pivotally coupled to the handle connector 514 via retaining pin 511. Referring to FIG. 6, a side cross-sectional view of the cleaning device is illustrated taken generally along the lines 6-6 in FIG. 5. As illustrated, the first component 502 provides support for a mop portion 610. In one embodiment, the mop portion 610 is retained on the first component 502 via mop retain portion 612 that fits around at least a portion of a top surface 503 of the first component 502. The second component 504 includes a first portion 605 that in this embodiment has a cross-sectional dome shape, a pad engaging portion 606 that provides support for the scrub pad 602 and a support 604 that provides a connection between the first portion 605 and the pad engaging portion 606. In this embodiment, the first portion 605 is made from a material that deflects in shape without braking when a force is applied. Such material may include polymer materials such as plastics that are hard yet flexible.

FIG. 6 further illustrates the scrub pad 602 in an inactive position. As illustrated, the scrub pad 602 is not touching floor surface 520. In this view only the mop portion 610 is engaged with the floor surface 520 to clean the floor surface 520. Referring to FIG. 7, a side cross-sectional view of the cleaning device having its scrub pad 602 in an active position is illustrated. As illustrated in FIG. 7, the scrub pad 602 is engaging a floor surface 520 in the active position. To get the scrub pad 602 in the active position in this embodiment, a downward force is asserted on the handle 512 towards the scrub pad 602. This is illustrated by the arrows in FIG. 7. The force causes the first portion 605 of the second component 504 to deflect thereby causing the support 604 of the second component 504 to push down on the pad engaging portion 606 of the second component 504. The amount of force needed to deflect the first portion 605 of the second component 504 can be selected by using a select material of a given thickness, stiffness or resistance that provides a desired flexibility.

Figure 8:
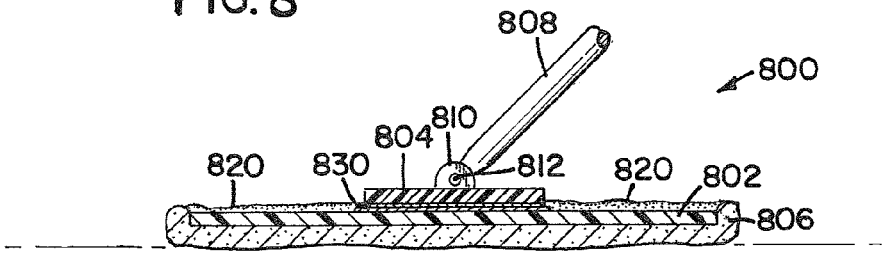
FIG. 8 is a side view of yet another embodiment of a cleaning device of the present invention.
Figure 9:
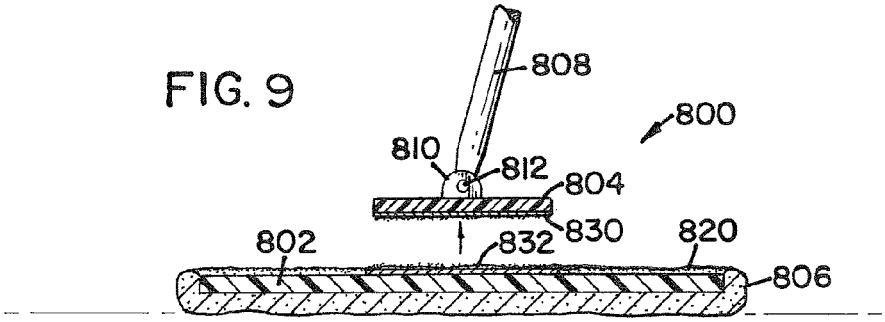
FIG. 9 is a side view of the embodiment of FIG. 8 illustrating the scrub pad removed from a mop portion.
Figure 10:
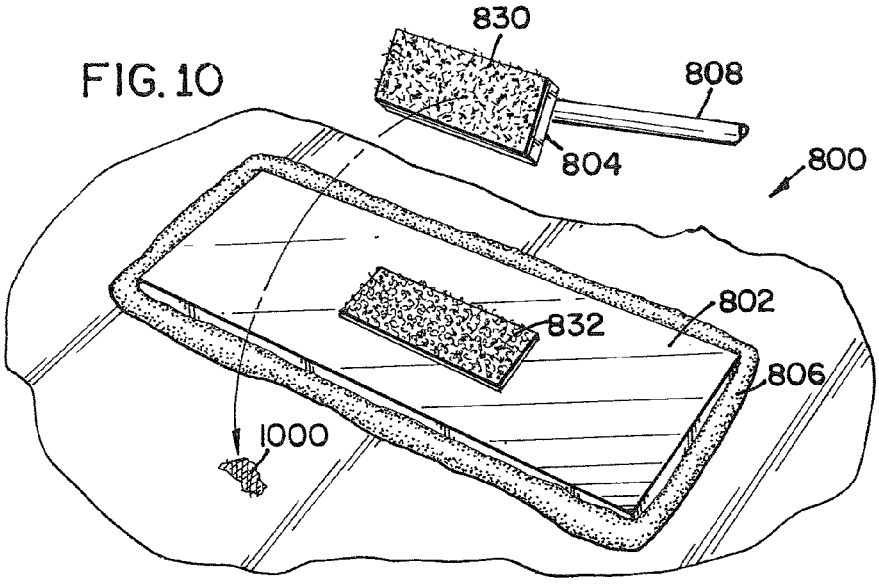
FIG. 10 is a top perspective view of the embodiment of FIG. 8 further illustrating the scrub pad removed from a mop portion.

Another embodiment of a cleaning device 800 is illustrated in the side view of FIG. 8. In this embodiment, the second component 804 is selectively coupled to the first component 802. FIG. 8 illustrates a scrub pad 830 in an inactive state. As illustrated, the cleaning device 800 of FIG. 8 includes a handle 808 that is pivotally coupled to a handle connector portion 810 via retaining pin 812. Also illustrated, is the first component 208 which provides a support for the mop portion 806. The mop portion 806 includes a mop retaining portion 820 which, in this embodiment, fits over the first component 802 to retain the mop portion 820 on the first component 802. FIG. 9 is side view that illustrates how the second component 804 is removed from the first component 802. In the embodiment of FIG. 9, a hook 830 and loop 832 connection system is used. In other embodiments different types of connections 830 and 832 are used, such as but not limited to magnetic connections, chemical connections, mechanical connections and the like. Further as illustrated in FIG. 9, the scrub pad 830 is used as part of the hook and loop fastener (830 and 832). Either side of the hook 830 and loop 834 can be used as the scrub pad depending on the material used and the desired performance. FIG. 10 further illustrates the application of the scrub pad on a scuff mark 1000 on a floor surface 830. In this embodiment, the scrub pad is removed from the first component 802 by placing a foot on an upper surface 801 of the first component 802 and pulling upward on the handle 808 to break the connection system. Once use of the scrub pad 830 has been complete, it is simply reattached to the first component 802 and the cleaning device 800 can be used as a mop.

Figure 11:
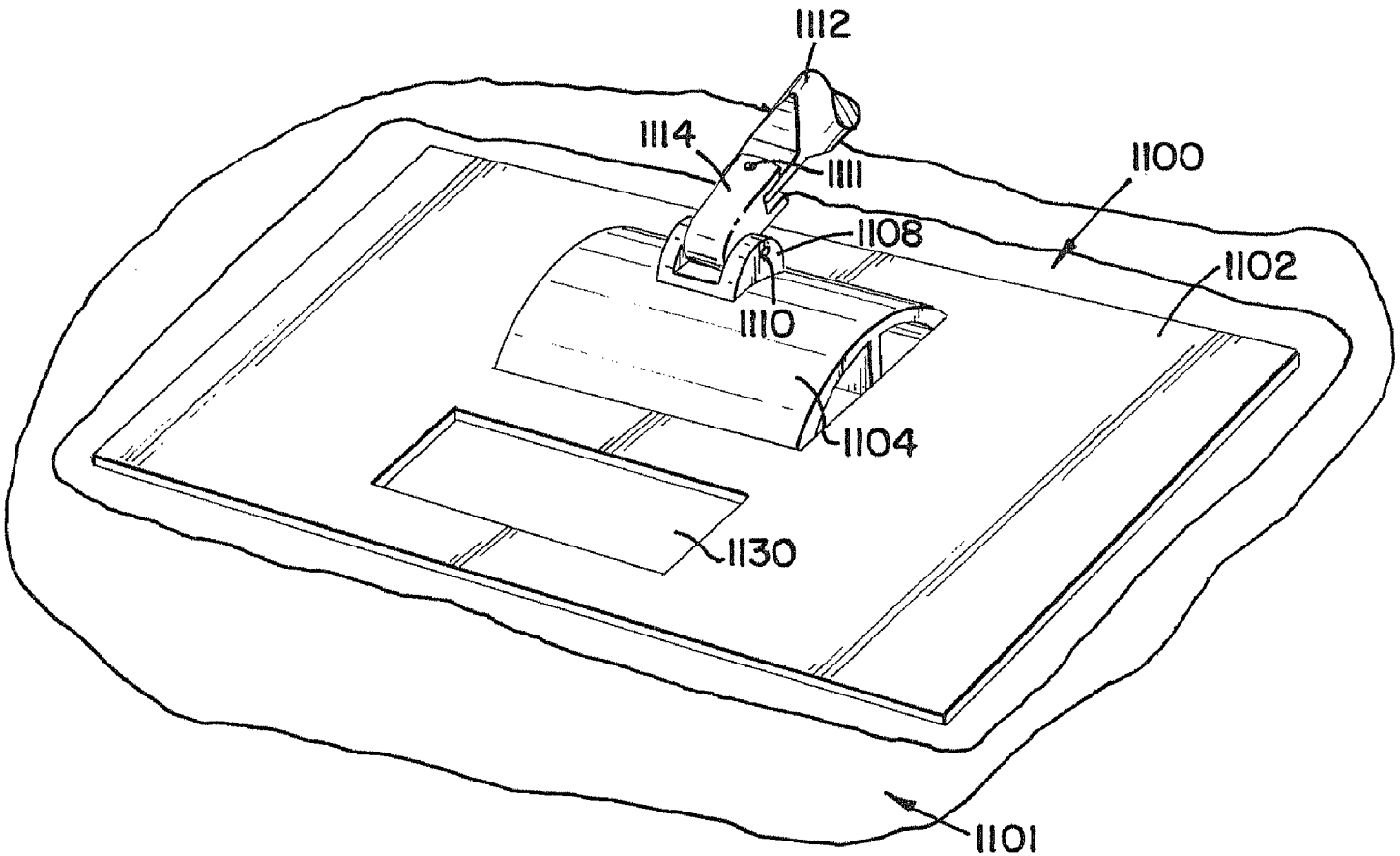
FIG. 11 is a top perspective view of another embodiment of a cleaning device of the present invention.

FIG. 11 is a front perspective view of another embodiment of a cleaning device 1100. This embodiment also includes a first component 1102 and a second component 1104. A connection bracket 1108 is coupled to the second component 1104. A handle connector 1114 is pivotally coupled to connection bracket 1108 via retaining pin 1110. Further, a handle 1112 is pivotally coupled to the handle connector 1114 via retaining pin 1111. In this embodiment, a window 1130 in the first component 1102 allows viewing of a floor surface under the cleaning device 1100.

Although specific embodiments have been illustrated and described herein, it will be appreciated by those of ordinary skill in the art that any arrangement, which is calculated to achieve the same purpose, may be substituted for the specific embodiment shown. For example, one or more embodiments could be used as a cleaning device for windows, counter tops, appliances, etc. Hence, this application is intended to cover any adaptations or variations of the present invention. Therefore, it is manifestly intended that this invention be limited only by the claims and the equivalents thereof.

The invention claimed is:

1. A cleaning device comprising:

a first component configured to hold and maintain a first flat mop portion of the cleaning device in a plane to engage a surface to be cleaned;

a second component configured to hold a second portion of the cleaning device, the second component movably connected between an inactive position and an active position to the first component, wherein the active position places the second portion within the plane of the first mop portion, further wherein the first and second components are configured so that the first flat mop portion and the second portion on the respective first and second components are independently replaceable;

a handle coupled to the second component to control an application of at least one of the first flat mop portion and the second portion of the cleaning device on the surface to be cleaned, wherein the second component is configured to move the second portion to engage a floor surface when a select amount of force is exerted on the handle in a direction toward the second component;

a first retaining bracket; and a second retaining bracket, the first and second retaining brackets configured to movably couple the first component to the second component.

2. The cleaning device of claim 1, wherein the second portion is a scrub pad.

3. The device of claim 1, wherein each of the first and second brackets include:

a first portion having at least one aperture used to connect the respective bracket to the first component; and a second portion having at least one aperture used to slideably connect the respective bracket to the second component.

4. The device of claim 3, further comprising:

a fastener extending through each aperture in the first portion of the first and second brackets, each fastener configured to threadably engage a threaded bore in the first component;

a retaining guide member extending through each aperture in the second portion of the first and second brackets, each retaining guide member having a head end and a threaded end, the threaded end of each retaining guide member threadably engaging a threaded bore in the second component; and a biasing member for each retaining guide member, each biasing member received around a mid portion of an associated retaining guide member, each biasing member having a first end abutting a first surface of a second portion of an associated first and second bracket, each biasing member further having a second end abutting the head of an associated retaining guide member, wherein each biasing member biases its associated retaining guide member to position the second component to proximate a second surface of the second portion of the first and second brackets.

5. The device of claim 4, wherein each biasing member is a spring configured to compress when a force is exerted on the handle therein allowing the scrub pad on the second component to contact a floor surface.

6. A cleaning device comprising:

a first component configured to hold and maintain a first flat mop portion of the cleaning device in a plane to engage a surface to be cleaned;

a second component configured to hold a second portion of the cleaning device, the second component movably connected between an inactive position and an active position to the first component, wherein the active position places the second portion within the plane of the first mop portion, further wherein the first and second components are configured so that the first flat mop portion and the second portion on the respective first and second components are independently replaceable;

a handle coupled to the second component to control an application of at least one of the first flat mop portion and the second portion of the cleaning device on the surface to be cleaned, wherein the second component is formed from a material that deflates when a force is exerted on the handle to cause the second portion to engage the surface to be cleaned;

the second component including, a first portion having a cross-sectional dome shape;

a pad engaging portion configured to retain the second portion; and a support coupled between the first portion and the pad engaging portion, wherein the support portion pushes the pad engaging portion towards the floor surface when the first portion deflects.

7. The device of claim 1, further including:

a window in the first component that allows an operator to view the surface to be cleaned while in use.

8. The device of claim 1, further comprising:

the first component and the second component having a first configuration and second configuration, the first configuration being a cleaning configuration and the second configuration being a scrubbing configuration.

9. The device of claim 1, wherein the first component has a perimeter and an aperture within the perimeter, the second component extending at least partially through the aperture when moved between the active and inactive positions.

10. A floor cleaning device comprising:

a first component configured to hold and maintain a flat mop portion of the cleaning device in a plane to engage a floor surface;

a second component configured to hold a scrub pad of cleaning device, the second component movably coupled in a first inactive position and a second active position to the first component, wherein the second active position is within the plane of the flat mop portion; and a handle coupled to the second component to control an application of the flat mop portion and the scrub pad of the cleaning device;

the second component including, a first portion having generally a cross-sectional dome shape, the handle coupled to the first portion, the first portion further formed from a material that deflects when a force is exerted on the handle, a second portion configured to retain the scrub pad, and a support coupled between the first portion and the second portion, wherein the support portion pushes the second portion towards the floor surface when the first portion deflects.

11. The floor cleaning device of claim 10, wherein the second component is configured to move from the first inactive position to the second active position by applying a select amount of force on the handle in the direction of the second component.

12. The floor cleaning device of claim 10, wherein the first portion of the second component is made from polymer material.

13. The floor cleaning device of claim 10, wherein the second component is located within a boundary defined by an outer perimeter of the first component such that the scrub pad held by the second component is surrounded by the flat mop portion held by the first component on all sides at least when the second component is in the inactive position.

14. The floor cleaning device of claim 10, further including:

a window in the first component that allows an operator to view the surface to be cleaned while in use.

15. A flat mop with an abrasive pad device comprising:

a first component configured to engage and maintain a flat mop in a plane to engage a floor surface to be cleaned;

a second component configured to engage an abrasive pad, the second component movably connected to the first component in a vertical direction between an inactive position and an active position, the second component further positioned within a boundary defined by an outer perimeter of the first component such that the abrasive pad is surrounded by at least a portion of the flat mop in all horizontal directions at least when the second component is in the active position, the flat mop and the abrasive pad being independently interchangeable on the respective first and second components;

a biasing member configured to provide a biasing force to position the second component in the inactive position when the abrasive pad is not in use, wherein in the inactive position the abrasive pad is raised a select vertical distance from the floor surface;

a handle coupled to the second component to control movement of the device over the floor surface, the handle further configured to force the second component into the active position so the abrasive pad engages the floor surface by applying a select amount of pressure to the second component to counter the biasing force supplied by the biasing member;

a first retaining bracket; and a second retaining bracket, the first and second retaining brackets configured to movably couple the first component to the second component.

16. The device of claim 15, wherein the biasing member further comprises:

the first bracket having a first section operatively connected to the first component and a second section having at least one guide aperture;

a first retaining guide member for each guide aperture of the first bracket, the first retaining guide member having a head end, an engaging end and a mid portion positioned between the head end and the engaging end, the mid portion of the first retaining guide member received in an associated guide aperture of the second section of the first bracket, the engaging portion of each first retaining guide member being engaged with the first component;

a first spring for each first retaining guide member, the first spring positioned around the mid portion of the first retaining guide member between the head end of the first retaining guide member and the second component;

the second bracket having a first section coupled to the first component and a second section having at least one guide aperture;

a second retaining guide member for each guide aperture of the second bracket, the second retaining guide member having a head end, an engaging end and a mid portion positioned between the head end and the engaging end, the mid portion of the second retaining guide member received in an associated guide aperture of the second section of the second bracket, the engaging portion of each second retaining guide member being engaged with the first component; and a second spring for each second retaining guide member, the second spring positioned around the mid portion of the second retaining guide member between the head end of the second retaining guide member and the second component.

17. The device of claim 15, wherein the biasing member further comprises:

at least one pliable portion of the second component configured to deflect under an applied force to place the abrasive pad in the active position.

* * * * *